US006073737A

United States Patent [19]

Kang

[11] Patent Number: 6,073,737

[45] Date of Patent: Jun. 13, 2000

[54] LUGGAGE SYSTEM FOR DETACHABLY SECURING AND TRANSPORTING MULTIPLE LUGGAGE PIECES

[76] Inventor: Won Kang, 26347 Thousand Oaks Blvd. #187, Calabasas, Calif. 91302

[21] Appl. No.: 09/295,512

[22] Filed: Apr. 21, 1999

[51] Int. Cl.[7] ..... A45F 13/00

[52] U.S. Cl. ..... 190/18 A; 190/15; 190/8; 190/113; 220/23.4; 280/37; 280/460.1

[58] Field of Search ..... 190/115, 117, 190/108, 113, 111, 21; 280/37, 38, 400, 409, 460.1, 461.1; 220/23.2, 23.4

[56] References Cited

U.S. PATENT DOCUMENTS

| | | | |
|---|---|---|---|
| 203,961 | 5/1878 | Siclen | 190/21 X |
| 1,084,360 | 1/1914 | Rahm | 190/108 |
| 3,042,238 | 7/1962 | Bryan et al. | 220/23.4 X |
| 3,823,973 | 7/1974 | Ramer | 220/23.4 X |
| 4,819,820 | 4/1989 | Weiner | 220/23.4 X |
| 5,630,521 | 5/1997 | Waddell et al. | 190/18 A |
| 5,690,196 | 11/1997 | Wang | 190/115 |
| 5,762,168 | 6/1998 | Miyoshi | 190/18 A |

*Primary Examiner*—Stephen P. Garbe
*Assistant Examiner*—Tri M. Mai
*Attorney, Agent, or Firm*—Edgar W. Averill, Jr.

[57] ABSTRACT

A luggage system for detachably securing and transporting multiple luggage pieces in a side-by-side arrangement. The luggage system has at least a first luggage piece and a second luggage piece, each having a generally oblong rectangular configuration with a top wall, a bottom wall, a front wall, a rear wall, a first sidewall, a second sidewall opposite the first sidewall, and a hollow inner cavity, with the top and bottom walls of the first luggage piece aligning with the top and bottom walls respectively of the second luggage piece. Each luggage piece has at least three wheels extending below a bottom wall of each luggage piece. The luggage system has means for detachably securing the first luggage piece to the second luggage piece when positioned in a side-by-side arrangement to the first luggage piece. The means for detachably securing is located near the front wall and the rear wall of each luggage piece. And a means for handling the luggage system is provided to push, tow, and steer the luggage system.

13 Claims, 4 Drawing Sheets

LUGGAGE SYSTEM FOR DETACHABLY SECURING AND TRANSPORTING MULTIPLE LUGGAGE PIECES

BACKGROUND OF THE INVENTION

The field of the invention generally pertains to luggage and suitcases. The invention relates more particularly to a luggage system for detachably securing and transporting multiple luggage pieces in a side-by-side arrangement.

Travelers often use more than one luggage piece to carry their clothing, personal items, and other articles for use in their travels. This presents a considerable problem for travelers when carrying or transporting their luggage through airports, hotels, and the like. Although a traveler often has the option of renting or purchasing a separate luggage cart, dolly, or hand truck, or retaining the services of airport or hotel personnel, these methods of transporting luggage are sometimes expensive, impractical, or burdensome on the traveler.

Various methods of arranging and securing together luggage pieces have been used in an effort to facilitate multiple luggage transport by an individual traveler. These methods typically employ a single piece of wheeled luggage with additional luggage pieces stacked and secured on top. For example, in both U.S. Pat. No. 3,960,252 and U.S. Pat. No. 5,699,886 additional luggage pieces are transported on top of a wheeled luggage piece functioning as the base of a dolly or hand truck. In U.S. Pat. No. 3,960,252 a portable case and collapsible trolley combination is shown having an extendable handle framework pivotally hinged to a portable case. When converting the combination for transport, the extendable handle framework is pivoted and extended and two wheels are rotated from side arms on the handle framework to form a dolly configuration. Additional pieces of luggage can be subsequently stacked on top of the portable case and transported in typical dolly fashion. Likewise, in U.S. Pat. No. 5,699,886, a luggage system is shown for transporting an additional luggage piece stacked on top of a wheeled luggage piece having an extendable tow handle. The additional luggage piece has a supplementary tow handle which is extended through the extendable tow handle of the wheeled luggage piece, and used to tow the combined luggage system. This arrangement secures the additional luggage piece from falling off the wheeled luggage piece during transport.

The methods disclosed in both U.S. Pat. No. 3,960,252 and U.S. Pat. No. 5,699,886, however, are generally insufficient to safely and reliably carry multiple luggage pieces, especially luggage pieces carrying heavy loads. Transporting heavy laden luggage pieces can be difficult to steer and control due to the high center of gravity when additional luggage pieces are stacked on a dolly. This is especially true when pushing the dolly in a forward manner rather than towing the dolly from behind. Moreover, luggage pieces stacked on a dolly can fall off during transport, and also have a tendency to topple over when the dolly is stood upright. Measures to secure luggage pieces in a stacked configuration may be insufficient. For example, the use of a supplementary tow handle in U.S. Pat. No. 5,699,886 may secure the additional luggage piece having the supplementary tow handle. All other additional luggage pieces, however, are not prevented from falling off during transport.

In addition to dolly arrangements, another method of arranging and transporting multiple luggage pieces is shown in U.S. Pat. No. 4,771,871 disclosing a luggage with a self-contained convertible wheeled carrier. The luggage has a first article holding compartment pivotally hinged to a second article holding compartment having wheels mounted on its side walls. This enables the luggage to convert into an additional luggage carrying position as shown in FIG. 1. In this operative position, the second article holding compartment functions as a wheeled base for placing additional luggage pieces.

As can be seen in FIG. 6 of this disclosure, however, this method requires considerable effort by the traveler to convert the luggage from the folded conventional luggage carrying position to the unfolded additional luggage carrying position. This can be a frustrating and burdensome task for most rushed and weary travelers, especially when the article holding compartments are heavily laden. Moreover, converting the luggage to the additional luggage carrying position requires the loading and unloading of all additional luggage pieces placed on the luggage which may compound the frustration.

Finally, in U.S. Pat. No. 5,099,968, a suitcase assembly is shown having first and second suitcase components which are capable of being assembled in two different arrangements. The first suitcase component has a plurality of caster wheels on its bottom surface, and a plurality of recesses on its top surface and on one side surface. And the second suitcase component has a plurality of projections on its bottom surface and on one side surface which mate with the top and side recesses respectively of the first suitcase component, preferably by magnetic force. In a first arrangement, the second suitcase component is positioned on top of the first suitcase component with the projections engaging the recesses. This first arrangement enables the suitcase assembly to be pushed or pulled. And in a second arrangement, the first and second suitcase components are positioned in a side-by-side manner with the projections engaging the recesses.

As with the dolly method of arranging and securing multiple luggage pieces, the suitcase assembly disclosed in U.S. Pat. No. 5,099,968 also poses several transporting problems. In the first arrangement, stacking the suitcase components raises the center of gravity of the suitcase assembly. This arrangement heightens the risk of falling over and accidental disassembly during transport. This is especially true when traveling over irregular surfaces. Although magnetic force is preferably used to engage the projections and the recesses, magnetic force alone is insufficient to prevent against accidental disassembly. It would be safer and easier to control a combination luggage arrangement having a low center of gravity. Moreover, the second side-by-side arrangement is not intended to be used for transport; it does not allow the suitcase assembly to be pushed, pulled, or otherwise transported in a side-by-side manner. Rather the side-by-side arrangement of the suitcase components serves only as a temporal chair for the traveler to sit on.

BRIEF SUMMARY OF THE INVENTION

It is an object of the present invention to provide a simple, reliable, and convenient luggage system for detachably securing and transporting multiple luggage pieces in a side-by-side arrangement.

The present invention is for a luggage system for detachably securing and transporting multiple luggage pieces in a side-by-side arrangement. The luggage system has at least a first luggage piece and a second luggage piece, each having at least three wheels extending below its bottom wall, and a means for detachably securing the first luggage piece to the second luggage piece in a side-by-side arrangement. The means for detachably securing has at least one first extending assembly positioned within the hollow inner cavities of the first and second luggage pieces near the front walls, and at least one second extending assembly positioned within the hollow inner cavities of the first and second luggage pieces near the rear walls. Each of the at least one first and second extending assemblies has an extending member held in a track in one of the first or second luggage pieces, and a corresponding mating-receiving-and-locking element in the other one of the first or second luggage pieces. In one embodiment of the luggage system, each extending member and corresponding track member is positioned in the first luggage piece, and each corresponding mating-receiving-and-locking element is positioned in the second luggage piece. When the luggage system is assembled, each extending member of the first luggage piece is partially extended into the corresponding mating-receiving-and-locking element of the second luggage piece. The extending member is temporarily held by a locking pin which is controllably moved and inserted into a passageway on a leading end of each extending member. Additionally, a means for handling the luggage system assembly is provided to push, tow, and steer the luggage system. In one embodiment, the means for handling the luggage system includes a handle member which is retractable when not in use, and can be inserted in a handle well fixedly mounted inside each luggage piece for pushably and steerably operating the luggage system. The handle assembly also has a stopper element affixed near the top of the handle well which is used both for towing the luggage system and preventing the handle member from completely exiting the luggage piece.

DETAILED DESCRIPTION OF THE PREFERRED EMBODIMENTS

Figure 3:
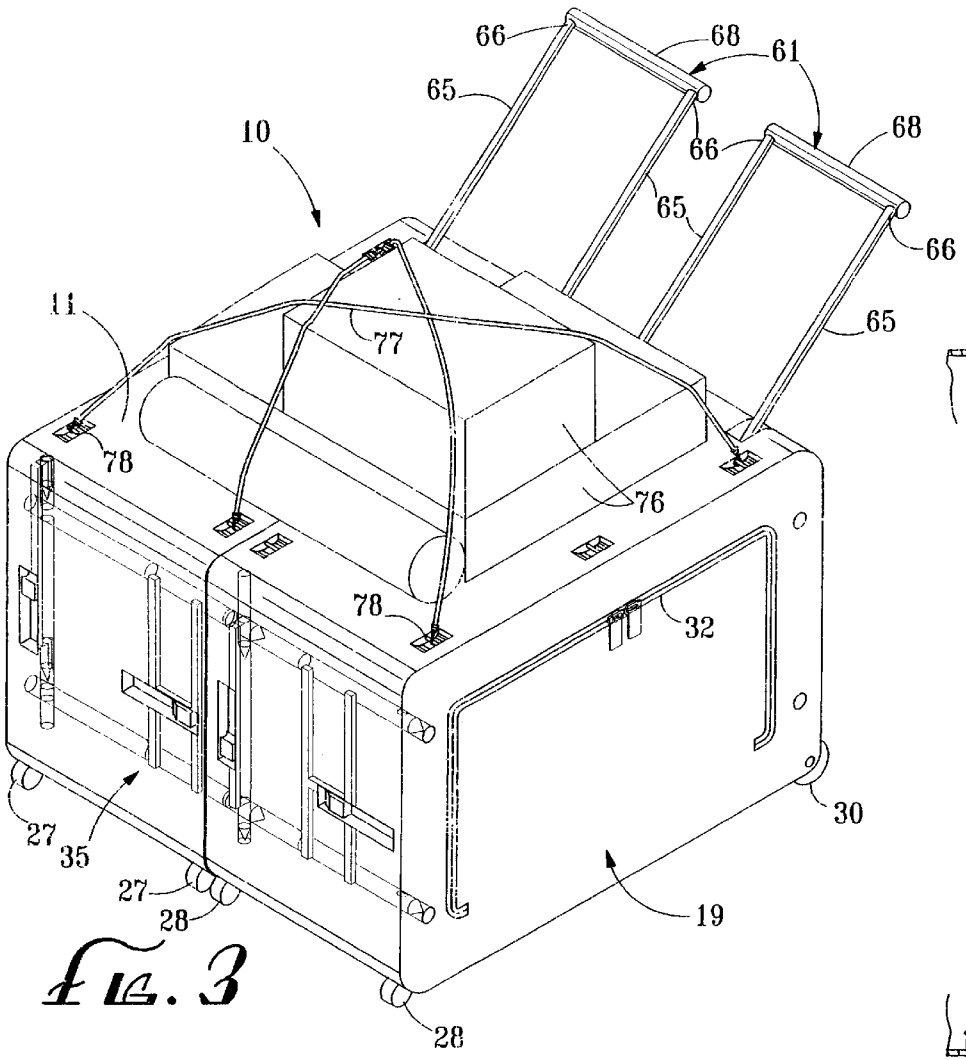
FIG. 3 is a perspective view of the luggage system assembled and operational.

Referring now to the drawings, FIG. 3 illustrates a luggage system, generally indicated at 10, for detachably securing multiple luggage pieces in a side-by-side arrangement. FIG. 3 shows a perspective view of the luggage system 10, and its component first luggage piece, generally indicated at 11, and its component second luggage piece, generally indicated at 19. The luggage system 10 is shown completely assembled and ready to be transported.

Figure 1:
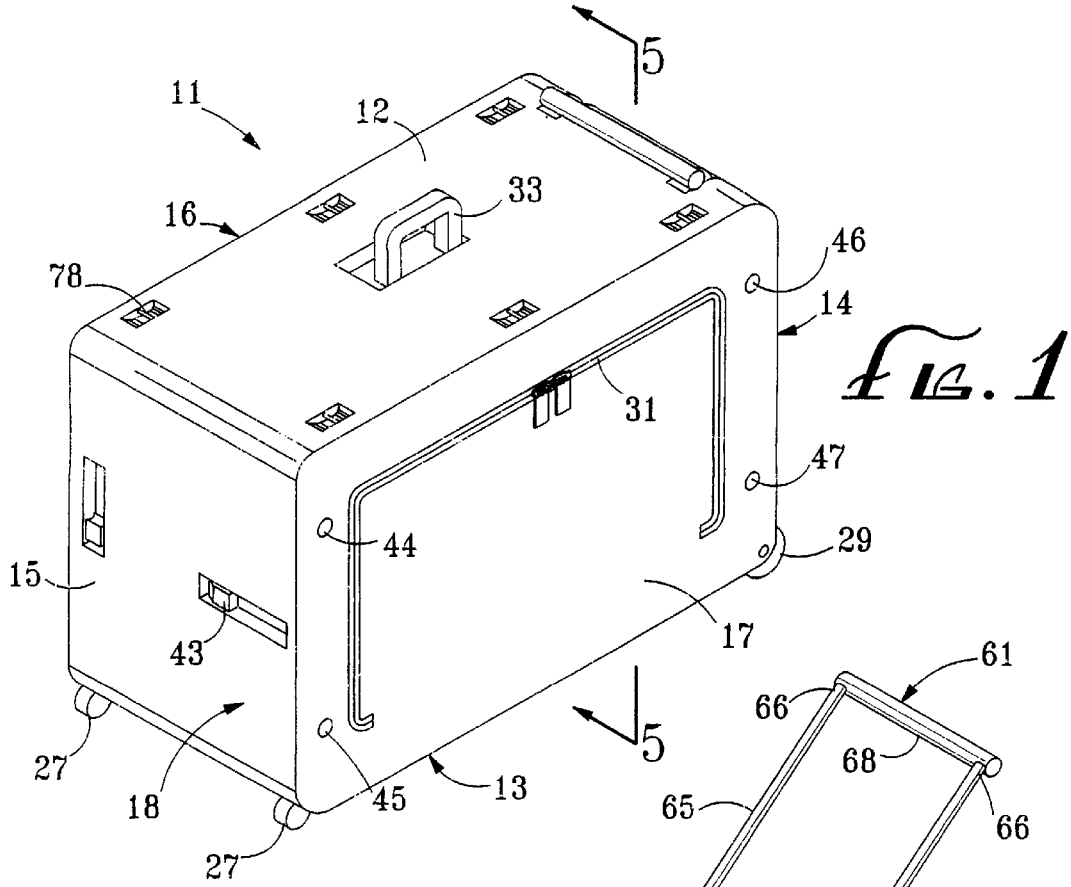
FIG. 1 is a perspective view of the first luggage piece generally facing the rear wall, and with the handle member retracted.

Details of the first luggage piece 11 are best seen in FIG. 1. The first luggage piece 11 has a generally oblong rectangular configuration with a top wall 12, a bottom wall 13, a front wall 14, a rear wall 15, a first sidewall 16, a second sidewall 17 opposite the first sidewall 16, and a hollow inner cavity 18. And FIGS. 2 and 6 best show the details of the second luggage piece 19 which also has a generally oblong rectangular configuration similar to the first luggage piece 11, with a top wall 20, a bottom wall 21, a front wall 22, a rear wall 23, a first sidewall 24, a second sidewall 25 opposite the first sidewall 24, and a hollow inner cavity 26.

Figure 5:
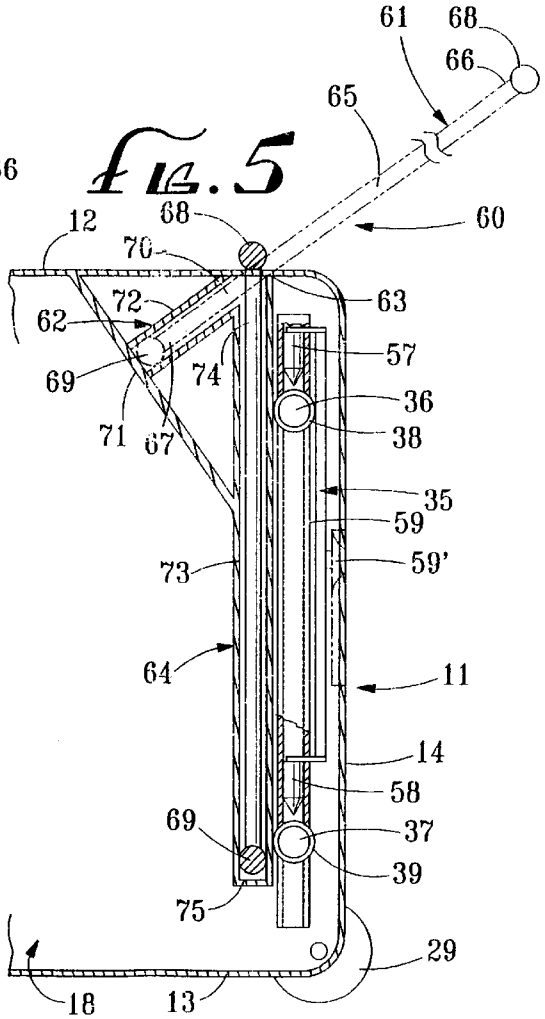
FIG. 5 is a cross-sectional view taken along the line of 5—5 of FIG. 1.

As can be best seen in FIGS. 1–3, 5, and 6, each luggage piece 11, 19 has at least three wheels extending below its bottom wall 13, 21. Preferably four wheels of a conventional caster type are used, including a pair of smaller caster wheels 27, 28 near the rear wall 15, 23, and a pair of larger caster wheels 29, 30 near the front wall 14, 22. As best shown in FIG. 5, the pair of larger caster wheels 29, 30 are preferably mounted on a corner edge of the front wall 14, 22 and the bottom wall 13, 21, extending below the bottom wall 13, 21 and beyond the front wall 14, 22. This is to facilitate transporting the luggage system 10 over curbs and the like in a dolly fashion while maintaining control. Each luggage piece 11, 19 also has a conventional means for opening and closing the luggage piece 31, 32, such as a zipper, on at least one of the first sidewall 16, 24 and second sidewall 17, 25. And a conventional carrying handle 33, 34 is affixed to each top wall 12, 20 for manually carrying the luggage pieces 11, 19 individually.

Figure 4:
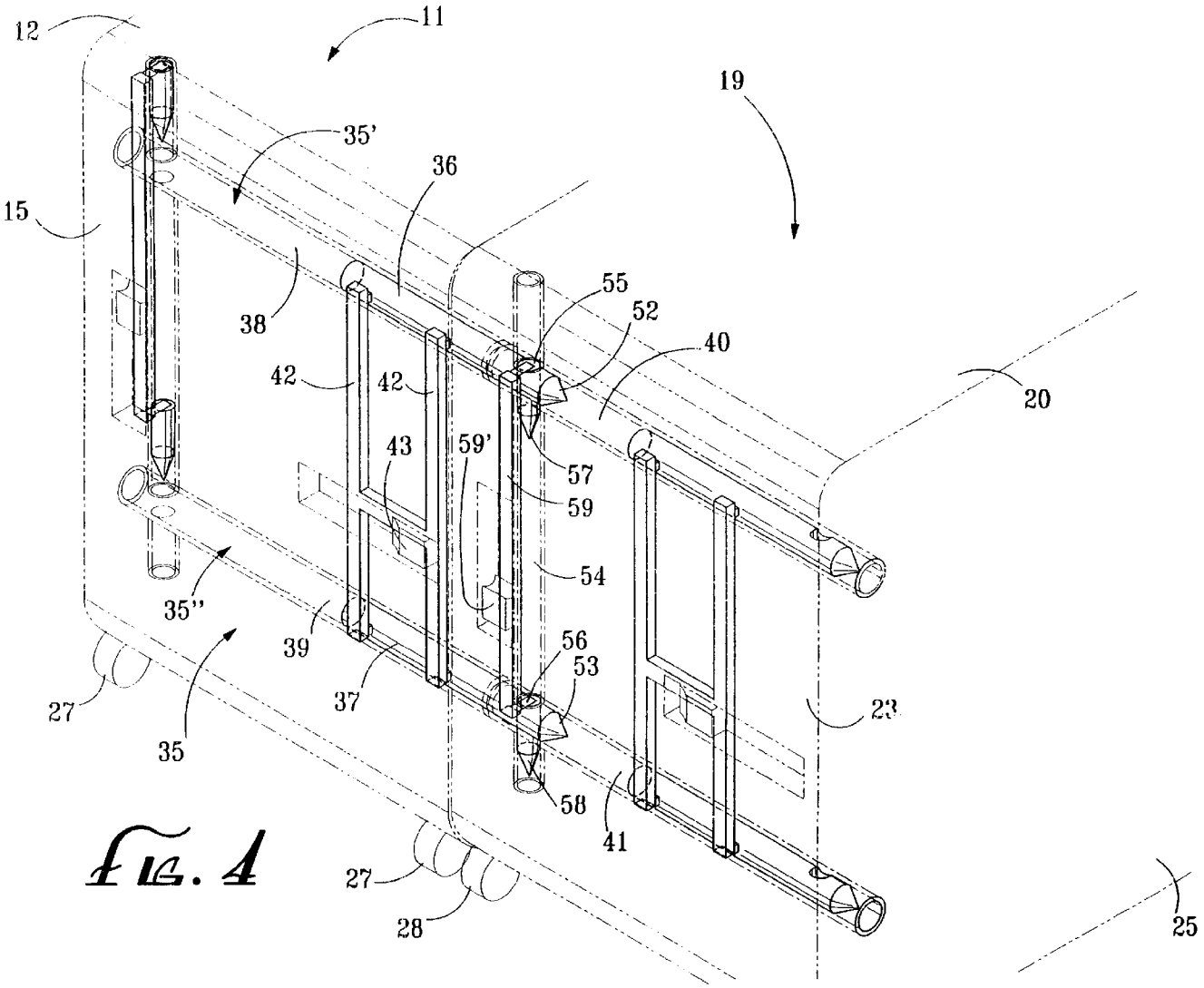
FIG. 4 is an enlarged perspective view of the means for detachably securing the first luggage piece to the second luggage piece generally facing the rear walls of the luggage pieces.

As can be seen in FIGS. 3 and 4, the luggage system 10 also has a means for detachably securing the first luggage piece 11 and the second luggage piece 12 in a side-by-side configuration, generally indicated at 35. The means for detachably securing 35 comprises at least one first extending assembly 35' positioned within the hollow inner cavities 18, 26 near the front walls 14, 22 of the first and second luggage pieces 11, 19, and at least one second extending assembly 35" positioned within the hollow inner cavities 18, 26 near the rear walls 15, 23 of the first and second luggage pieces 11, 19. (See FIG. 5) As can be seen in FIG. 5, the means for detachably securing 35 is positioned within the hollow inner cavities 18, 26 of the first and second luggage pieces 11, 19. Details of the means for detachably securing 35 can be best seen in FIG. 4 showing an enlarged perspective view of the means for detachably securing 35 the first luggage piece 11 to the second luggage piece 19 located near the front wall 14, 22 and the rear wall 15, 23 of each luggage piece 11, 19. In particular, FIG. 4 shows one embodiment of the means for detachably securing 35 having a pair of second extending assemblies 35" and 36" with two extending members 36, 37 movably held by corresponding track members 38, 39 within the hollow inner cavity 18 near the rear wall 15 of the first luggage piece 11, and a corresponding number of mating-receiving-and-locking elements 40, 41 affixed within the hollow inner cavity 26 near the rear wall 23 of the second luggage piece 19. Likewise, (but not shown) a pair of extending members is movably held by corresponding track members within the hollow inner cavity 18 near the front wall 14 of the first luggage piece 11, and a corresponding number of mating-receiving-and-locking elements within the hollow inner cavity 26 near the front wall 22 of the second luggage piece 19. When referencing the position of the first or second extending assemblies 35' and 35" to the front 14, 22 or rear walls 15, 23, it is understood that the extending assemblies 35' and 35" are substantially near the respective front or rear walls without necessarily being affixed to either. This is supported in the drawings and can be best seen in FIG. 5. However, the proximity of the extending assemblies 35' and 35" must be sufficiently close to enable manual actuation of the extending members 36, 37 from outside the luggage pieces.

Figure 6:
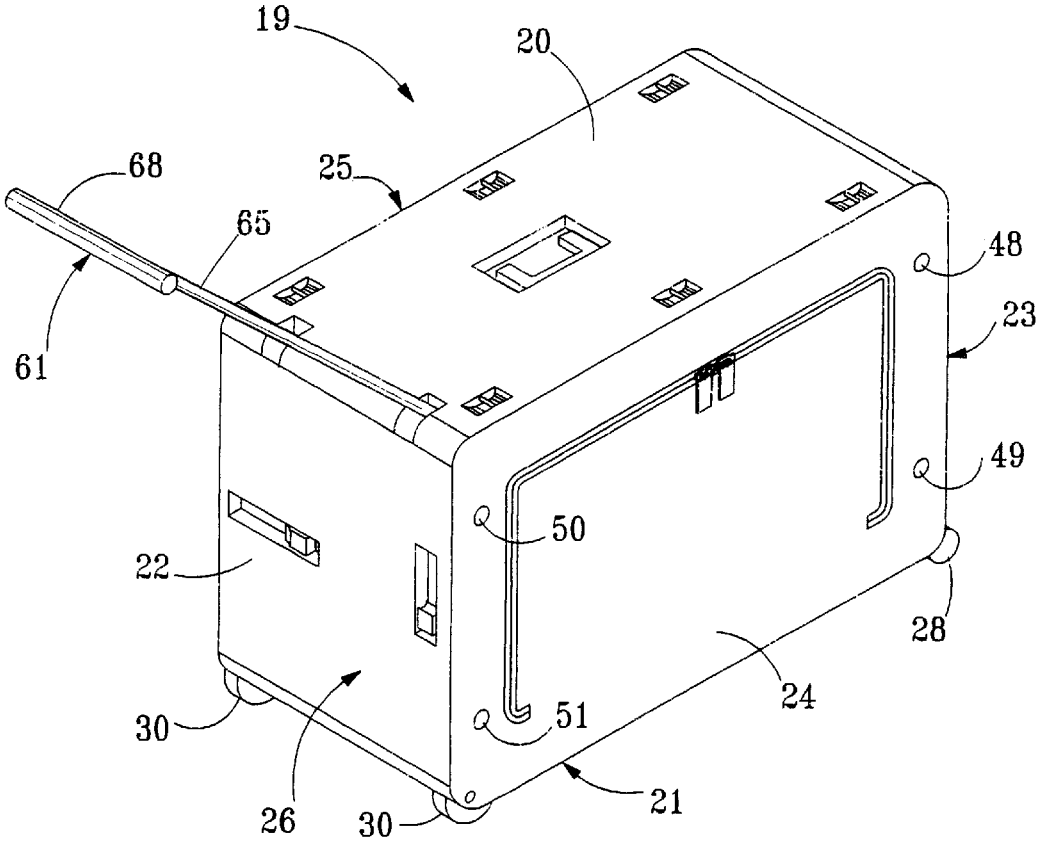
FIG. 6 is a perspective view of the second luggage piece generally facing the front wall, and with the handle member extended.

The track members 38, 39 are preferably hollow tubes, and each extending member 36, 37 is preferably a shaft slidably held in the corresponding hollow tube. Each pair of extending members 36, 37 is connected by at least one and preferably two joined vertical crossbars 42 having a main actuator arm 43 exposed and accessible from outside the luggage pieces 11, 19. The main actuator arm 43 is used to manually extend and retract the connected pair of extending members 36, 37 simultaneously. As can be seen in FIG. 1, the extending members 36, 37 near the rear wall 15 partially extend out from the luggage piece 11 through exit openings 44, 45 on the second sidewall 17 of the first luggage piece 11. Similarly, and as can be seen in FIG. 6, the first sidewall 24 of the second luggage piece 19 has receptacle openings 48, 49 near the rear wall 23 which open into the mating-receiving-and-locking elements 40, 41. Each extending member 36, 37 has a leading end 52, 53 which enters the mating-receiving-and-locking element 40, 41 through the receptacle opening 48, 49. Each mating-receiving-and-locking element 40, 41 has a means for releaseably holding the leading end 54 of the corresponding extending member 36, 37. The means for releaseably holding the leading end 54 comprises a passageway 55, 56 near the leading end 52, 53 of the extending member 36, 37, and two locking pins 57, 58 positioned to be controllably moved in and out of the passageway 55, 56 of each extending member 36, 37. The means for releaseably holding the leading end 54 further includes a connector bar 59 connecting the two locking pins 57, 58, and a lock actuator arm 59' for moving said locking pins 57, 58 in and out of the passageways 55, 56 of each extending member 36, 37. In this manner, the first luggage piece 11 can be detachably secured to the second luggage piece 19.

Figure 2:
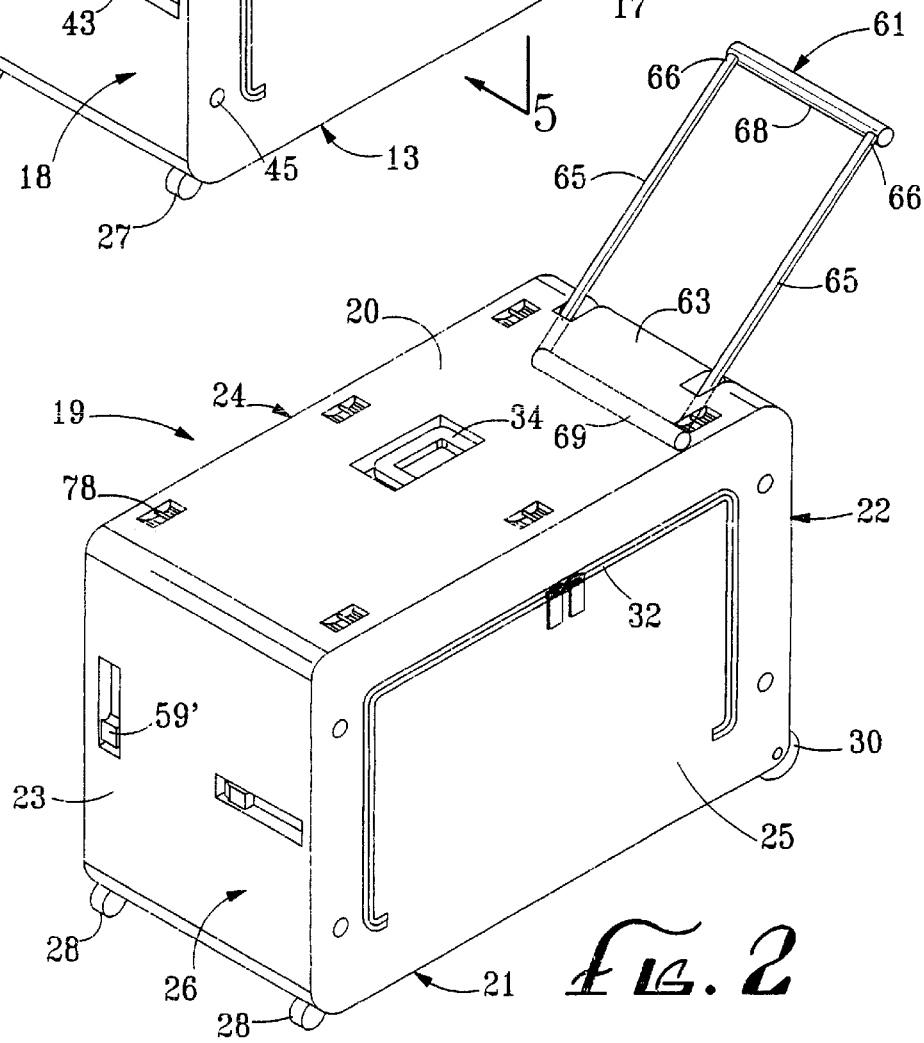
FIG. 2 is a perspective view of the second luggage piece generally facing the rear wall, and with the handle member extended.

As can be best seen in FIGS. 1–3, 5, and 6 each luggage piece also includes a means for handling the luggage system, generally indicated at 60, to push, tow, and steer the luggage system 10. The means for handling 10, comprises a handle member 61, a handle well 62, a stopper element 63, and a means for storing away said handle member when not in use, generally indicated at 64. FIG. 1–3 generally show the means for handling 60 when the handle member 61 is both fully extended and fully stored away when not in use.

Details of the means for handling 60 are best seen in FIG. 5 showing a cross-sectional view taken along the line of 5—5 of FIG. 1. The handle member 61 has an elongated handle shaft 65 with an upper end 66 and a lower end 67, a handgrip 68 affixed to the elongated handle shaft 65 at the upper end 66, and a stopper bar 69 affixed to the elongated handle shaft 65 at the lower end 67. As shown in FIGS. 2, 3, 5, and 6, the elongated handle shaft 65 preferably has dual shafts which connect to the handgrip 68 and the stopper bar 69. The handle well 62 serves as the focal point when the luggage system 10 is being push operated. The handle well 62 is fixedly mounted inside the hollow inner cavity 18, 26 adjacent the front wall 14, 22 and extending to a corner edge of the top 12, 20 and front walls 14, 22. The handle well 62 has an open top 70, a closed bottom 71, and side walls 72 which permit the handle member 61 to slide upwardly and downwardly in said handle well 62. The luggage system 10 can be pushed and steered when the handle member 61 is inserted into the handle well 62. Preferably, the handle well 62 is angled less than 90 degrees below the surface of the top wall 12, 20 of the luggage piece 11, 19 to enable a user to push the luggage system in a comfortable, upright manner.

As can be best seen in FIGS. 2 and 5, the stopper element 63 serves as the focal point when the luggage system 10 is being tow operated. The stopper element 63 is fixedly mounted near the open top 70 of the handle well 62 and has a width less than the width of the open top 70. The stopper element 63 keeps the handle member 61 from extending completely out of the luggage piece 11, 19. This enables the stopper element 63 to tow the luggage system 10 when the stopper bar 69 abuts against the stopper element 63. And the means for storing away said handle member when not in use 64 preferably comprises a retraction pocket 73 having a retraction opening 74 affixed near the open top 70 of the handle well 62. The retraction opening 74 leads into a retraction cavity 75 where the handle member 61 is kept when not in use.

Additionally, as shown in FIG. 3, when the luggage pieces 11, 19 are detachably secured in a side-by-side configuration as discussed above, the top walls 12, 20 of the luggage pieces 11, 19 align together to create a flat surface. Additional luggage pieces 76 can subsequently be placed on top of the flat surface and separately secured. Preferably, a conventional strap 77 can be used to tie down the additional luggage pieces 76 to the top walls 12, 20 of the luggage pieces 11, 19 having a plurality of suitable tie-down anchors 78.

The present embodiments of this invention are thus to be considered in all respects as illustrative and not restrictive; the scope of the invention being indicated by the appended claims rather than by the foregoing description. All changes which come within the meaning and range of equivalency of the claims are intended to be embraced therein.

I claim:

1. A luggage system for detachably securing and transporting multiple luggage pieces in a side-by-side arrangement, said luggage system comprising:

at least a first luggage piece and a second luggage piece, each having a generally oblong rectangular configuration with a top wall, a bottom wall, a front wall, a rear wall, a first sidewall, a second sidewall opposite the first sidewall, and a hollow inner cavity, the top and bottom walls of the first luggage piece aligning with the top and bottom walls respectively of the second luggage piece;

at least three wheels extending below the bottom wall of each luggage piece; and means for detachably securing the first luggage piece to the second luggage piece positioned in a side-by-side arrangement to the first luggage piece, said means for detachably securing comprising:

at least one first extending assembly having an extending member movably held by a track member positioned within the hollow inner cavity near the front wall of one of the first and second luggage pieces, and a corresponding mating-receiving-and-locking element positioned within the hollow inner cavity near the front wall of the other of said first and second luggage pieces; and at least one second extending assembly having an extending member movably held by a track member positioned within the hollow inner cavity near the rear wall of one of the first and second luggage pieces, and a corresponding mating-receiving-and-locking element positioned within the hollow inner cavity near the rear wall of the other of said first and second luggage pieces.

2. A luggage system as in claim 1, wherein said at least one first extending assembly is a pair of first extending assemblies; and wherein said at least one second extending assembly is a pair of second extending assemblies.

3. A luggage system as in claim 2, wherein each extending member and corresponding track member is positioned in said first luggage piece, and each mating-receiving-and-locking element is positioned in said second luggage piece.

4. A luggage system as in claim 3, wherein each track member is a hollow tube, and each extending member is a shaft slidably held in the hollow tube.

5. A luggage system as in claim 4, wherein each shaft has a leading end, and each mating-receiving-and-locking element includes an opening in the second side wall and means for releaseably holding the leading end of the corresponding shaft.

6. A luggage system as in claim 5, wherein said means for releaseably holding the leading end comprises a passageway near the leading end of each extending member, and at least one locking pin positioned to be controllably moved in and out of the passageway.

7. A luggage system as in claim 6, wherein said means for releasably holding the leading end further comprises two locking pins, and a connector bar connecting the two locking pins, said connecting bar having a lock actuator arm for moving said locking pins in and out of the passageways.

8. A luggage system as in claim 2, wherein the pair of extending members of said pair of first extending assemblies is connected by at least one vertical crossbar having a main actuator arm, and the pair of extending members of said pair of second extending assemblies is connected by at least one vertical crossbar having a main actuator arm, for simultaneously extending and retracting the respective pairs of extending members.

9. A luggage system for detachably securing and transporting multiple luggage pieces in a side-by-side arrangement, said luggage system comprising:

at least a first luggage piece and a second luggage piece, each having a generally oblong rectangular configuration with a top wall, a bottom wall, a front wall, a rear wall, a first sidewall, a second sidewall opposite the first sidewall, and a hollow inner cavity, the top and bottom walls of the first luggage piece aligning with the top and bottom walls respectively of the second luggage piece;

at least three wheels extending below the bottom wall of each luggage piece;

means for detachably securing the first luggage piece to the second luggage piece positioned in a side-by-side arrangement to the first luggage piece, said means for detachably securing comprising:

at least one first extending assembly having an extending member movably held by a track member positioned within the hollow inner cavity near the front wall of one of the first and second luggage pieces, and a corresponding mating-receiving-and-locking element positioned within the hollow inner cavity near the front wall of the other of said first and second luggage pieces; and at least one second extending assembly having an extending member movably held by a track member positioned within the hollow inner cavity near the rear wall of one of the first and second luggage pieces, and a corresponding mating-receiving-and-locking element positioned within the hollow inner cavity near the rear wall of the other of said first and second luggage pieces; and means for handling the luggage system during rolling transport, whereby the luggage system can be pushed, towed, and steered.

10. A luggage system as in claim 9, wherein said means for handling the luggage system comprises:

a handle member having an elongated handle shaft with an upper end and a lower end, a handgrip affixed to the elongated handle shaft at the upper end, and a stopper bar affixed to the elongated handle shaft at the lower end;

a handle well fixedly mounted inside the hollow inner cavity adjacent the front wall and extending to a corner edge of the top and front walls, said handle well comprising an open top, a closed bottom, and side walls which permit the handle member to slide upwardly and downwardly in said handle well, whereby the handle member is inserted into said handle well for pushing and steering said luggage system;

a stopper element fixedly mounted near the open top of the handle well, said stopper element having a width less than the width of the open top, whereby the handle member is kept from falling into the luggage piece and kept from extending completely out of the luggage piece, for towing said luggage system; and means for storing away said handle member when not in use.

11. A luggage system as in claim 10, wherein said means for storing away said handle member comprises a retraction pocket having a retraction opening affixed near the open top of the handle well, the retraction opening leading into a retraction cavity for storing away the handle member when not in use.

12. A luggage system for detachably securing and transporting multiple luggage pieces in a side-by-side arrangement, said luggage system comprising:

at least a first luggage piece and a second luggage piece, each having a generally oblong rectangular configuration with a top wall, a bottom wall, a front wall, a rear wall, a first sidewall, a second sidewall opposite the first sidewall, and a hollow inner cavity, the top and bottom walls of the first luggage piece aligning with the top and bottom walls respectively of the second luggage piece;

at least three wheels extending below the bottom wall of each luggage piece;

means for detachably securing the first luggage piece to the second luggage piece positioned in a side-by-side arrangement to the first luggage piece means for detachably securing the first luggage piece to the second luggage piece when positioned in a side-by-side arrangement to the first luggage piece; and means for handling the luggage system during rolling transport, whereby the luggage system can be pushed, towed, and steered, said means for handling the luggage system comprising:

a handle member having an elongated handle shaft with an upper end and a lower end, a handgrip affixed to the elongated handle shaft at the upper end, and a stopper bar affixed to the elongated handle shaft at the lower end;

a handle well fixedly mounted inside the hollow inner cavity adjacent the front wall and extending to a corner edge of the top and front walls, said handle well comprising an open top, a closed bottom, and side walls which permit the handle member to slide upwardly and downwardly in said handle well, whereby the handle member is inserted into said handle well for pushing and steering said luggage system;

a stopper element fixedly mounted near the open top of the handle well, said stopper element having a width less than the width of the open top, whereby the handle member is kept from falling into the luggage piece and kept from extending completely out of the luggage piece, for towing said luggage system; and means for storing away said handle member when not in use.

13. A luggage system as in claim 12, wherein said means for storing away said handle member comprises a retraction pocket having a retraction opening affixed near the open top of the handle well, the retraction opening leading into a retraction cavity for storing away the handle member when not in use.

* * * * *